US006361589B1

(12) United States Patent
Loreth

(10) Patent No.: US 6,361,589 B1
(45) Date of Patent: Mar. 26, 2002

(54) DEVICE FOR AIR CLEANING

(75) Inventor: Andrzej Loreth, Åkersberga (SE)

(73) Assignee: Eurus Airtech AB, Akersberga (SE)

( * ) Notice: Subject to any disclaimer, the term of this patent is extended or adjusted under 35 U.S.C. 154(b) by 0 days.

(21) Appl. No.: 09/463,391

(22) PCT Filed: Aug. 5, 1998

(86) PCT No.: PCT/SE98/01437

§ 371 Date: Jan. 28, 2000

§ 102(e) Date: Jan. 28, 2000

(87) PCT Pub. No.: WO99/07474

PCT Pub. Date: Feb. 18, 1999

(30) Foreign Application Priority Data

Aug. 6, 1997 (SE) ..... 9702871

(51) Int. Cl.[7] ..... B03C 3/45

(52) U.S. Cl. ..... 96/67; 55/520; 96/69; 96/98; 96/100

(58) Field of Search ..... 96/69, 67, 98, 96/100; 55/520

(56) References Cited

U.S. PATENT DOCUMENTS 3,702,049 A * 11/1972 Morris, Jr. ..... 55/520 X
3,841,840 A * 10/1974 Hundhausen et al. ..... 96/67 X
4,354,861 A * 10/1982 Kalt ..... 96/69
4,509,958 A * 4/1985 Masuda et al. ..... 96/67 X
4,781,736 A * 11/1988 Cheney et al. ..... 96/67 X
4,886,526 A * 12/1989 Joannou ..... 96/67
4,978,372 A * 12/1990 Pick ..... 96/67
5,466,279 A * 11/1995 Hattori et al. ..... 96/69
5,582,632 A * 12/1996 Nohr et al. ..... 96/69 X
5,716,431 A * 2/1998 Von Glehn ..... 55/520 X
5,728,199 A * 3/1998 Von Glehn ..... 55/520 X

FOREIGN PATENT DOCUMENTS

| | | | | |
|---|---|---|---|---|
| EP | 0049454 | * | 4/1982 | |
| FR | 1400684 | * | 5/1964 | |
| WO | 95/19225 | * | 7/1995 | |
| WO | 97/09117 | * | 3/1997 | ..... 96/69 |

* cited by examiner

*Primary Examiner*—Richard L. Chiesa
(74) *Attorney, Agent, or Firm*—Birch, Stewart, Kolasch & Birch, LLP

(57) ABSTRACT

A device is provided for cleaning air from charged particles in an air flow duct. The device includes at least one precipitator panel including one or more precipitator units that are arranged so that their inlets have a large extension relative to the cross-sectional area of the air flow duct and a relatively small extension in the direction of the air flow through the units. The precipitator panels include at least two electrode elements preferably connected to a high voltage source and located such that all air in the air flow duct passes through the respective electrode elements.

10 Claims, 8 Drawing Sheets

DEVICE FOR AIR CLEANING

This application is a national stage application of International Application No. PCT/SE98/01437, filed on Aug. 5, 1998.

TECHNICAL FIELD OF THE INVENTION

The present invention relates to a device for cleaning air from electrically charged particles (aerosols), said device including at least one precipitator panel, said panel including at least one precipitator unit having at least two electrode elements or at least two groups of electrode elements, said elements being located alternately relative to each other by a an internal gap distance, said electrode elements being suitably connected to respective terminals of a high voltage source, said device being located in an air flow duct or in immediate connection with an air flow duct.

PRIOR ART

Particle filters for use in ventilating applications or so called duct filters are usually designed around mechanical so called barrier filters. The separating capacity with regard to particle separation varies widely for these filters depending on the structural design (the filter class), i.e. coarse filters, fine filters and micro filters. Characterising for these filters are among other things an substantially increasing pressure drop in relation to the ability to separate micro particles. This disadvantage gives rise to a need for powerful air transporting fans, said fans having a high noise level and of course unnecessary high energy consumption together with expensive installation costs. Also, the increasing demands for improved indoor air and demands for clean ventilating ducts have increased the use of higher filter classes.

Mechanical filters of electrically charged fibres, so called electret filters, have initially better operation characteristics than other types of barrier filters. However, these characteristics are not operationally stable and decrease eventually.

The use of the traditional electro filter technique, i.e. using precipitators of metallic electrode elements instead of mechanical filters has up to now not been successful to any higher degree. This depends on high installation costs and complicated and expensive service. The recent development of the electro filter technique using filter cassettes of paper has up to now not been used in ventilating duct applications since also this technique has its limitations, especially in such a demanding environment as ventilating ducts, said environment having a temperature and a humidity that varies widely and an air flow velocity that is several times higher than in air cleaners, said air cleaners being the devices that the technique in question basically is developed for.

The reasons for said limitations are the following. The precipitator designed out of board (cellulose based material), i.e. high ohmic material, is affected by dust that bridges the gap between adjacent electrode elements, i.e. electrode elements connected to respective terminal of a high voltage source. This affection increases by increasing air humidity and decreases dramatically the particle separating capacity of electro filters. The bridging dust between adjacent electrode elements deflects namely the electrical charging from the surfaces of the electrode elements, the effect of this is that the potential between said surfaces decreases and consequently that the particle (aerosols) separation capacity decreases.

OBJECTS AND FEATURES OF THE INVENTION

The aim of the present invention is to eliminate said limitations and thus create a practical and economical alternative for a new type of ventilating filter or duct filter of electrostatic character. In this connection the expression duct filter defines, apart from filters for domestic ventilation, i.e. filters for supply air and/or exhaust air, also other applications, e.g. filters for coupes of motor cars, i.e. integrated in the ventilating device of the motor car, and also other industrial applications having relatively high air flow velocities. It is of course also possible to use the technique in other circumstances, e.g. when designing air cleaners, cooker hoods etc. The most important advantages with the new type of filter are the high separating capacity of micro particles also in combination with simultaneous separation of heavier particles, this being effected by an extremely low pressure drop and simple service using a vacuum cleaner or replacement of the filter.

DETAILED DESCRIPTION OF THE PREFERRED EMBODIMENTS THE INVENTION

The present invention will below be described more in detail, reference being made to the accompanying figures.

Figure 1:
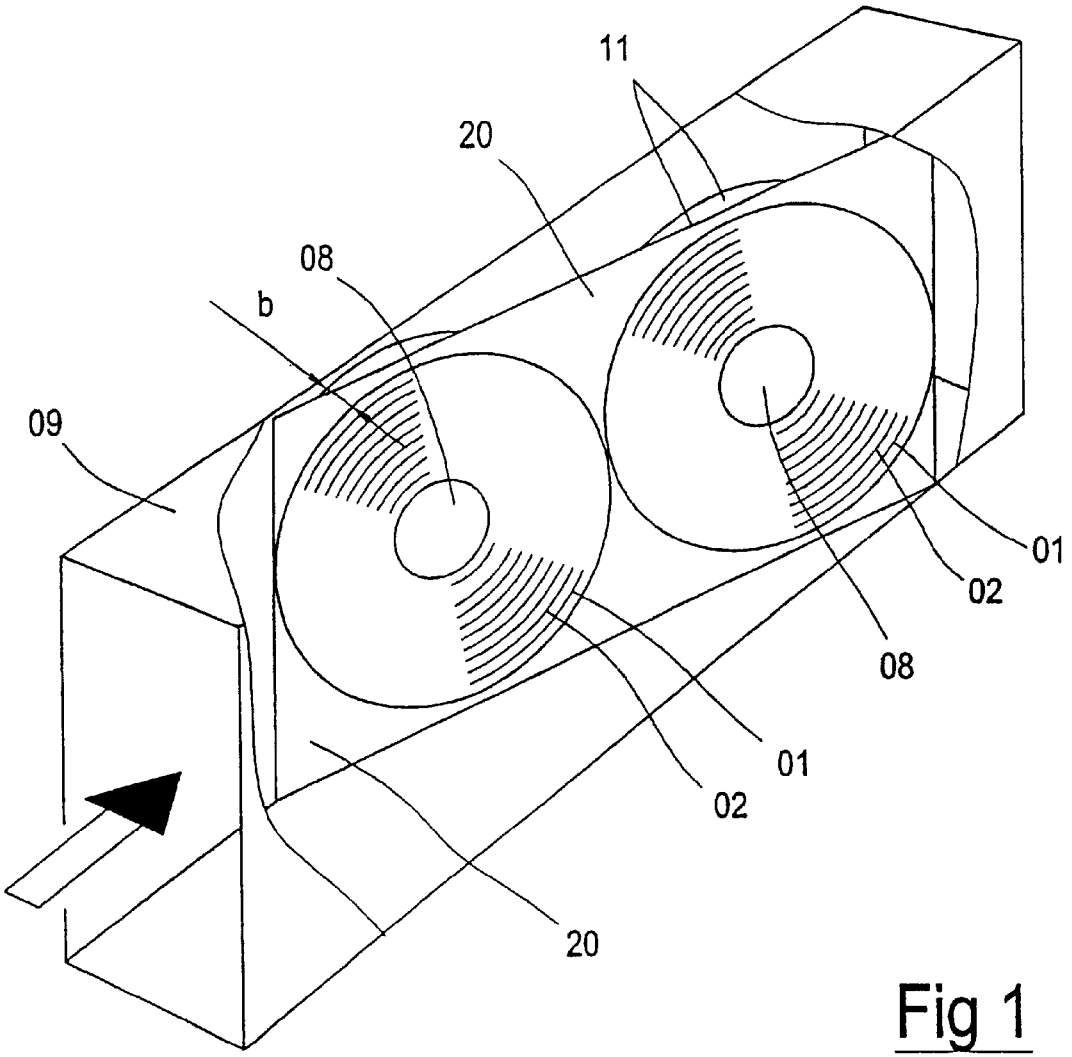
FIG. 1 is a schematic perspective view of a first embodiment of a device according to the present invention, a portion of a ventilating duct being cut away.

FIG. 1 shows schematically the first embodiment of the present invention. A precipitator in the shape of panel 11 is provided in an air flow duct 09, the inlet area A of said panel 11 being located inclined across the air flow duct 09, seen in the air flow direction through the duct, and in such a way that essentially all air transport takes place through the precipitator panel 11. This can also be expressed as the precipitator panel 11 is inclined relative to the air flow direction through the device.

The precipitator panel 11 may according to the characterising features include one or more units, i.e. independent precipitators, each unit consisting of at least two electrode elements 01, 02 or at least two groups of electrode elements preferably connected to respective terminals of a high voltage source HVU, said units being pervious to the air flow and having a gap distance "d" between adjacent electrode elements 01, 02.

The depth "b" of the precipitator 11, i.e. the shortest way for the air flow to pass through said precipitator 11, is essentially smaller than the extension of the inlet area A of the precipitator 11.

According to what is shown in FIG. 1 the precipitator panel 11 may preferably consist of one or more precipitator units designed in accordance with patent application PCT/SE97/00956 or similar embodiments, i.e. essentially circular units or significantly rounded units comprising at least two band-like electrode elements 01, 02 arranged at a gap distance "d" relative to each other, said elements being provided to circle several times around an axis, or a bobbin body 08 substituting said axis, and connected in a suitable way to respective terminals of a high voltage source HVU.

In such an embodiment it is essential that the space between the active panel portion, i.e. the precipitator unit, and the inner walls of the air flow duct are impervious to air flow. This is effected in FIG. 1 by means of the cover 20 of the precipitator panel having essentially rectangular or square shape.

Figure 8:
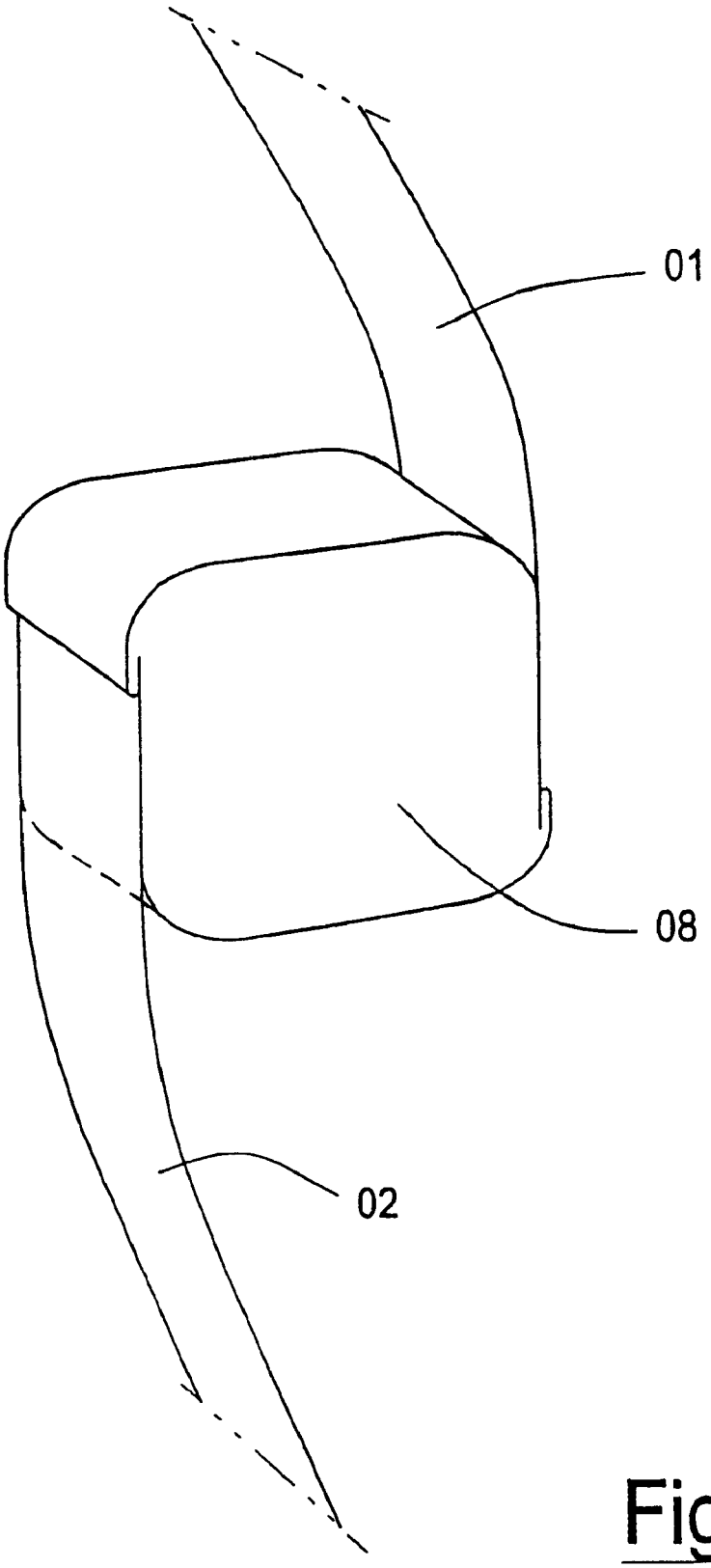
FIG. 8 is a schematic perspective view of a bobbin where band shaped electrode elements are wound around said bobbin.
Figure 9:
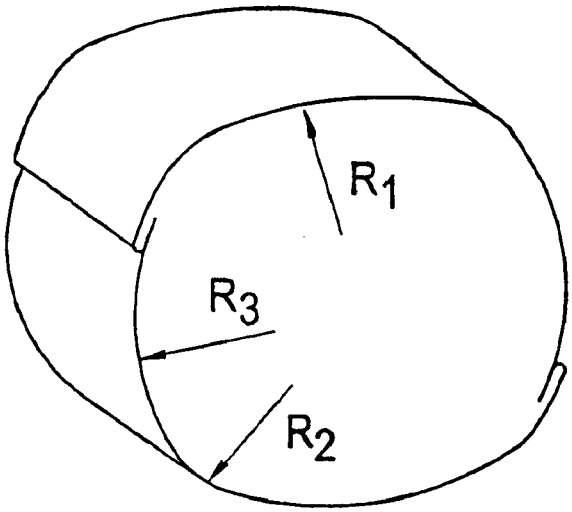
FIG. 9 is a schematic perspective view of an alternative design of a bobbin compared to FIG. 8.

Winding of the electrode elements 01, 02 around a bobbin body 08 of rectangular or square cross section, said body having significantly rounded edges as shown in FIG. 8, brings about a precipitator unit having a correspondingly shaped inlet area and creates a rounded version of the precipitator unit, said version having somewhat larger filling factor than a circular precipitator unit. However, the disadvantage is decreased mechanical stability and this must be considered for each application. In FIG. 9 is shown an improved bobbin body as regards mechanical stability and the inherent electrical stability and simultaneously better filling factor than the corresponding circular bobbin body, said bobbin body of FIG. 9 having at last two different radii and hence the band elements 01, 02 during substantially their entire length have a certain curvature. It is of course also possible to design the active panel portion to have a rectangular inlet area, i.e. with electrode elements 01, 02 being essentially parallel to each other. However, such a design is not equally stable neither from mechanical aspect nor from electrical aspect. The electrode elements 01, 02 have a deformation tendency when parameters relating to humidity/heat change and hence there is a risk for short-circuit between said elements.

Figure 2:
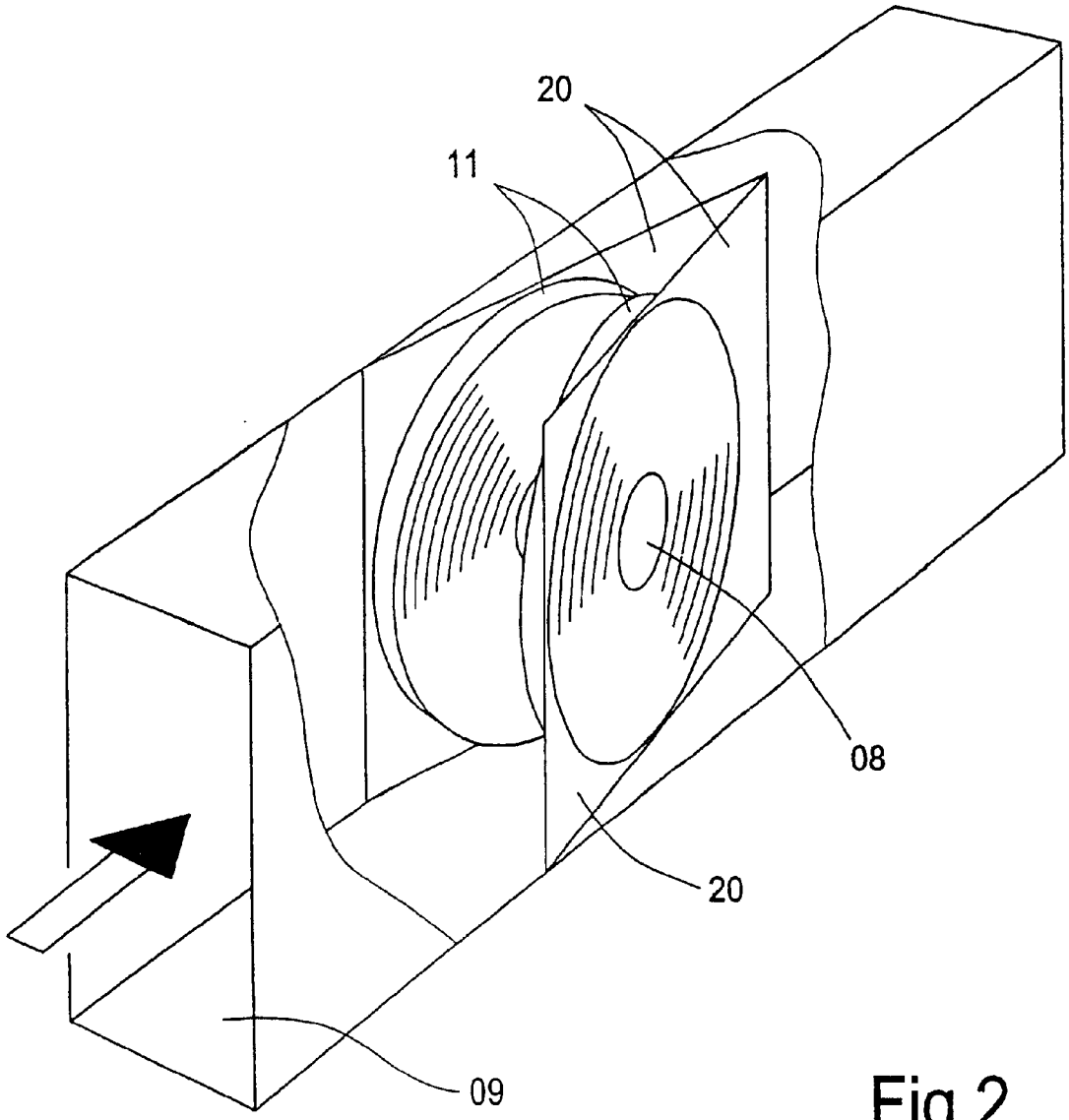
FIG. 2 is a schematic perspective view of a second embodiment of a device according to the present invention, a portion of a ventilating duct being cut away.

FIG. 2 shows an alternative embodiment of the present invention. Seen perpendicular to the air flow direction through the duct two precipitator panels 11 are located across the cross section of the air flow duct in such a way that all air transport takes place through the precipitator panels. The precipitator panels 11 are inclined across the air flow duct 09, said panels being joined at a downstream edge, thus creating a V-shaped precipitator unit.

Figure 3:
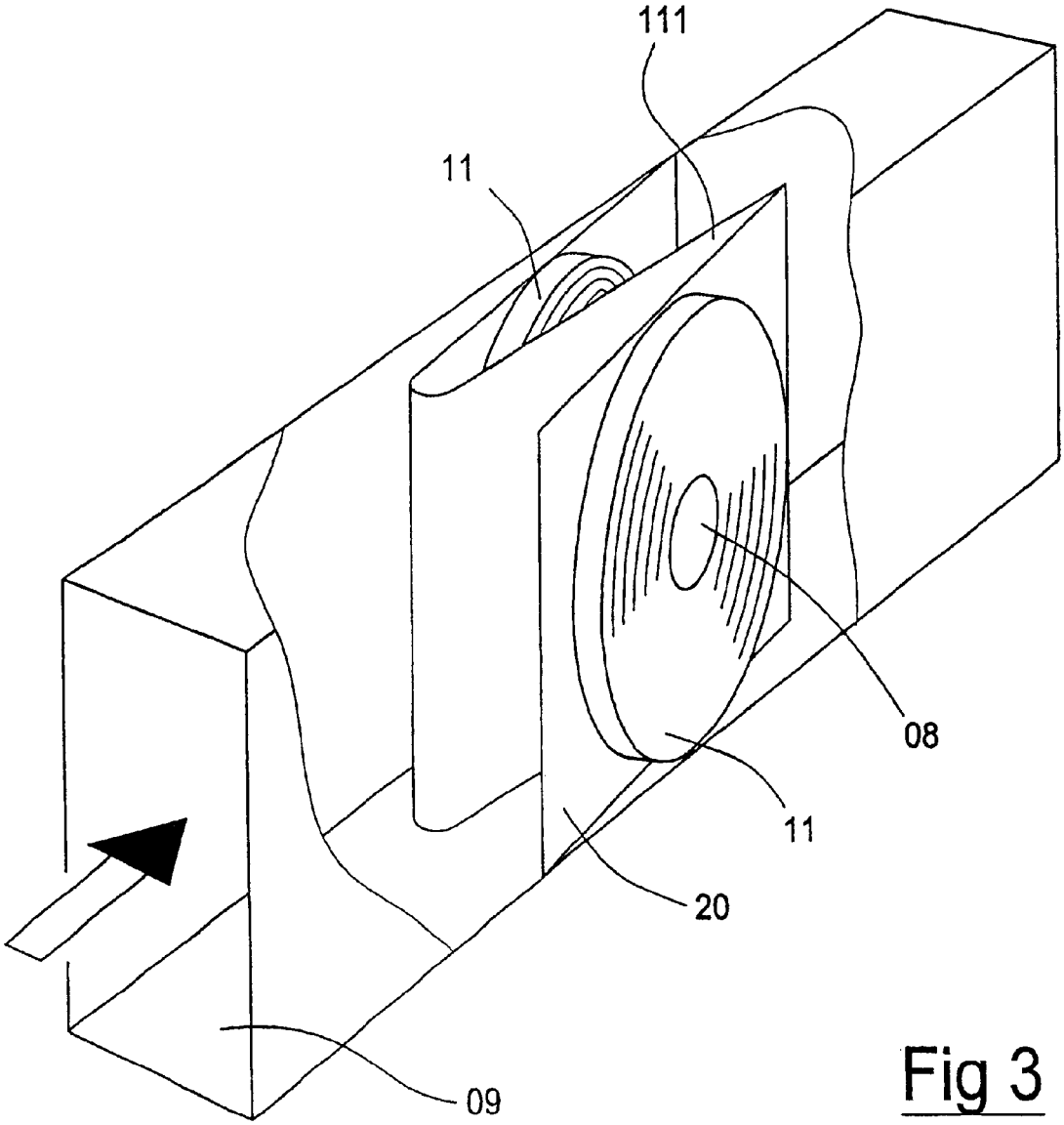
FIG. 3 is a schematic perspective view of a third embodiment of a device according to the present invention, a portion of a ventilating duct being cut away.

FIG. 3 shows another embodiment having two precipitator panels 11 arranged substantially parallel to each other and inclined relative to the air flow direction through the duct 09. A suitable filling surface 111, impervious to the air blow, is arranged in order to make all air transport to take place through the respective precipitator panel 11.

Figure 4:
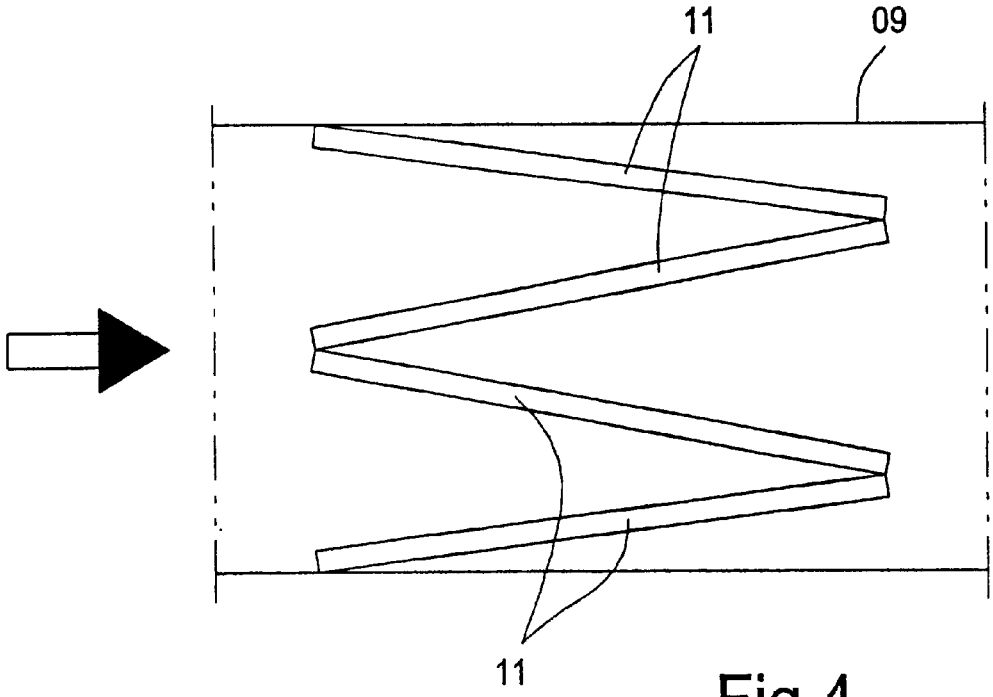
FIG. 4 shows schematically the possibility of multiple design of the embodiment according to FIG. 2.
Figure 5:
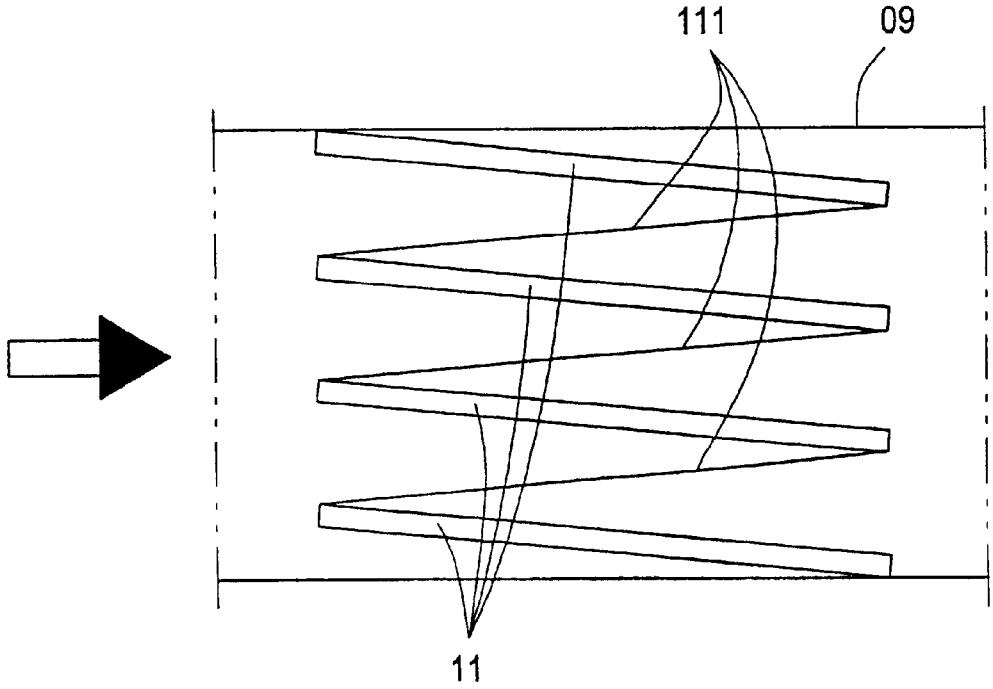
FIG. 5 shows schematically the possibility of multiple design of the embodiment according to FIG. 3.

FIG. 4 and 5 schematically show the possibility of multiple design of the embodiments shown in FIGS. 2 and 3.

The aggregated inlet area $A_{tot}$, i.e. the sum of all active surfaces, pervious to air flow, of the precipitator panels of the device should according to the present invention be sufficient large to guarantee, in combination with the gap distance "d" and the panel depth "b", essentially invariable operational features within a broad spectrum of changes as regards operative conditions, i.e. varying air humidity and temperature, also after pollution.

Such design has turned out to be possible since at sufficient low air flow velocity through the precipitator, in combination with relatively small gap distance "d" between adjacent electrode elements 01, 02 of the precipitator, dust accumulation takes place over the edge sections of the electrode elements, i.e. the inlet surface of the precipitator. By decreasing gap distance "d" there is a decreased migration tendency for heavy dust. This, as described above, to an essential degree decreases the dust influence upon the separation capacity of the precipitator, of course with disregard to the dust influence that arises across the edge sections of the respective electrode elements 01, 02 at the inlet area of the precipitator.

Therefore, the device according to the present invention should be designed on one hand with regard to the area enlargement X, i.e. the total inlet area $A_{tot}$ in relation to the cross section area of the air flow duct 09, as a function of the gap distance "d" between the electrode elements 01, 02 and on the other hand as a function of the depth "b" of the precipitator, i.e. the shortest way for air flow through the panel.

Figure 6:
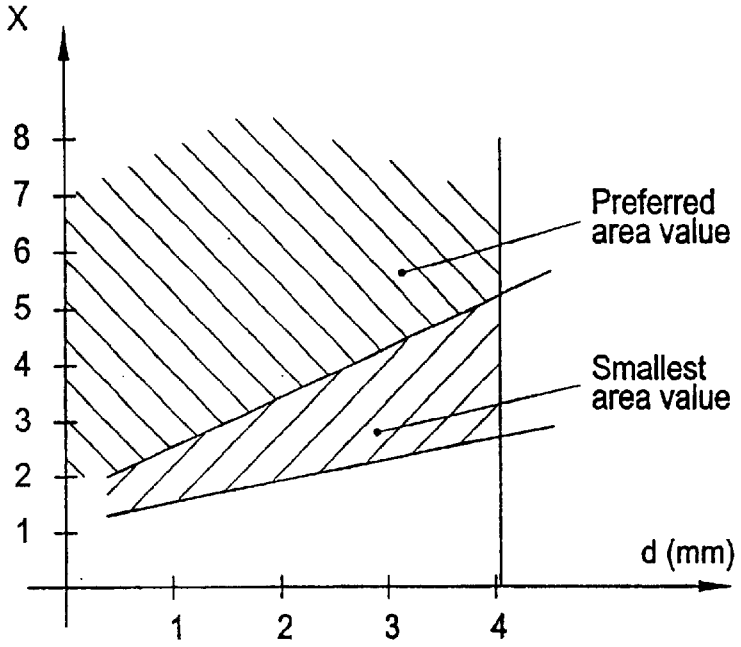
FIG. 6 is a diagram showing the relation between the area enlargement X and the gap distance "d"

The area enlargement factor X as a function of the gap distance "d" should according to the characterising claims be greater than a smallest value, and preferably greater than a preferred value according to the diagram of FIG. 6. The largest panel depth "b" should not exceed 10 cm and should as a preferred value and as a function of the gap distance "d" be within the shaded area according to FIG. 7.

Figure 7:
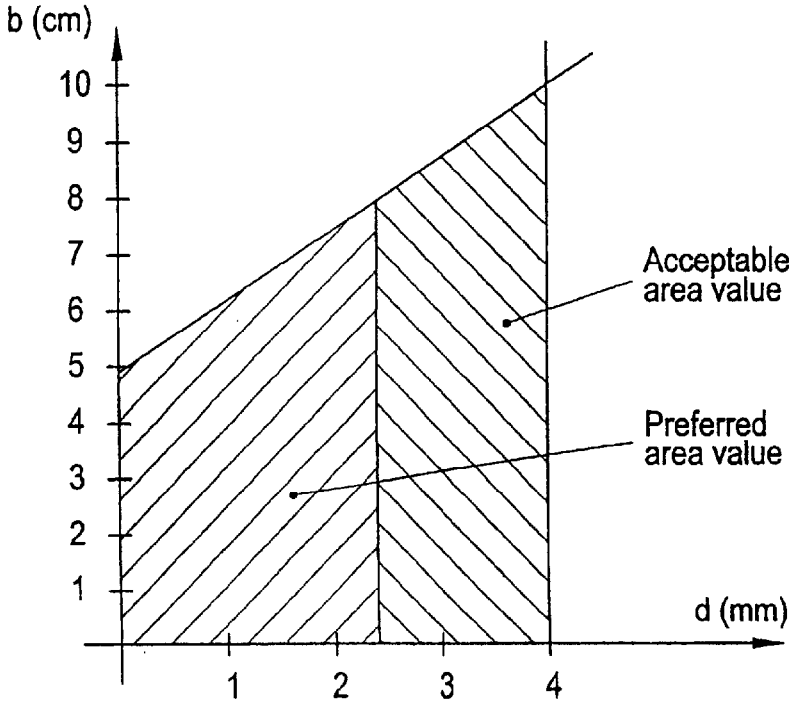
FIG. 7 is a diagram showing the relation between the depth "b" of the precipitator and the gap distance "d"

As is evident from FIGS. 6 and 7 and standardised dimensions of ventilating ducts up to 600×600 mm it is the question of relatively large mechanical structures. In laboratory tests it has turned out that with a gap distance "d" up to 4 mm and demands for mechanical and hence also electrical stability a preferred design for the precipitator panels 11 has band-like electrode elements 01, 02 of thin band-like material circled several times and preferably coated by a damp-resistant film. However, also other materials, both conductive, semi-conductive or dissipative may be used as well as other ways to design precipitator units. Of course there is no prevention from adapting the precipitator panels 11 to 300×300 mm ventilating ducts and also use such precipitator panels in ducts having a 600×600 mm cross section if the 600×600 mm duct is divided into four 300×300 mm equal portions. It is also preferred that the air flow duct where the device according to the present invention is to be located is area enlarged and thus the disposable air flow area is increased and thereby in practice larger area enlargement factor X may be achieved than otherwise would have been possible.

Figure 10:
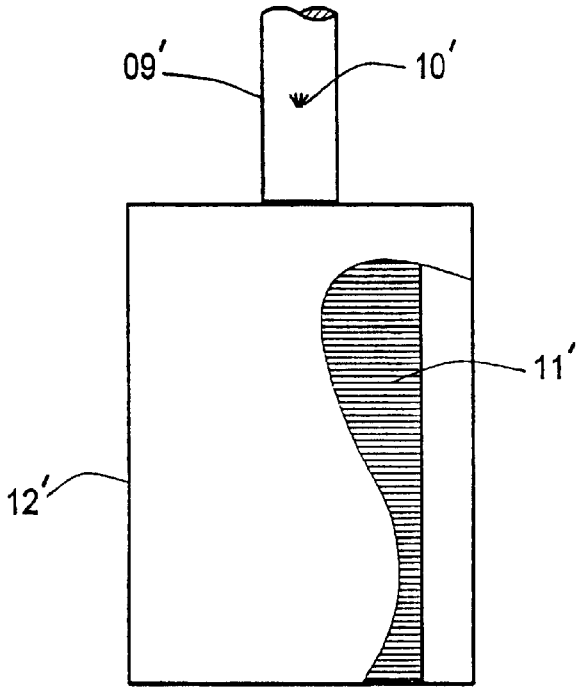
FIG. 10 is a schematic front view of a fourth embodiment of the device according to the present invention.
Figure 11:
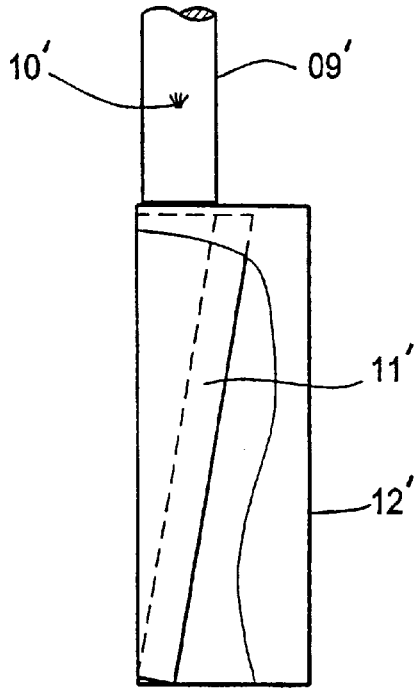
FIG. 11 is a schematic side view of the embodiment according to FIG. 10.
Figure 12:
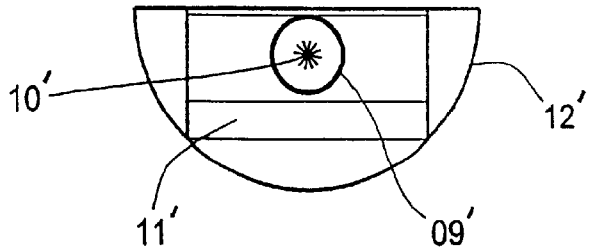
FIG. 12 is a schematic top view of the embodiment according to FIG. 10.

The embodiment shown in FIGS. 10–12 relate to a supply air terminal device comprising an air flow duct 09' having circular cross section and a transition space 12', preferably located in the wall area of a room. As is most clearly evident from FIG. 12 the transition space 12' has a substantially larger cross section area, seen in direction of the air flow, than the air flow duct 09'. Preferably the front side of the transition space is rounded. However, the air flow duct 09' and the transition space 12' may of course have other cross sections than those shown in FIGS. 10–12.

In the air flow duct 09' an ionisation device 10' may be provided in order to ionise the air flowing in the duct 09', said ionisation device 10' in a known way being connected to a high voltage source (not shown). In the transition space 12' a precipitator panel 11' is located, said panel 11' being inclined relative to the longitudinal direction of the air flow duct 09', i.e. the direction of the air flow itself. In a conventional way the electrode elements of the precipitator panel 11' are connected to respective terminals of a high voltage source (not shown). Preferably the precipitator is of the type described above in connection with FIG. 1. The precipitator panel 11' is arranged in such a way in the transition space 12' that essentially all air transport takes place through the precipitator panel 11'. Consequently at least a portion of the front side of the transition space 12' is pervious to air to emit into the room the air that has passed the precipitator panel. The reason why the cross section area of the transition space 12' is considerably larger than the cross section area of the air flow duct 09' is that the velocity of the air should be decreased before said air is emitted into the room. Otherwise people that are present in the room may experience an air draught from the device.

Contrary to mechanical filters designed according to different filter classes the filter system dimensioned and designed in accordance with the present invention may operate simultaneously as both coarse filter and micro filter. Such design rely upon a new knowledge of a practical possibility of considerably oversizing the precipitator units included in a device, this being effected by designing the total inlet area of the precipitator panels several times larger than the cross section area of the duct 09 (large area enlargement factor X) and decreasing gap distance "d".

In practice increasing area enlargement factor X decreases the air flow velocity through respective precipitator unit. Within a broad range of possible potential decrease between the electrodes 01, 02 this does not affect the separation capacity of said precipitator unit. Decreasing gap distance "d" has turned out to decrease or prevent the migration of the bridging dust between adjacent electrode elements 01, 02, this in its turn prevents potential decrease between said elements.

It is of course also possible to arrange so called cascade systems, i.e. two or more corresponding filter systems mounted subsequently after each other seen in the direction of the air flow in the channel.

An upper limit for the area enlargement factor X does not exist and the possibility of higher X-values for a certain given ventilating duct is increasing, among other things through decreasing gap distance "d" and decreasing band width of the electrode elements 01, 02.

The invention defined in the claims is not limited to any special material for the electrode elements 01, 02 of the precipitator but precipitators of high-ohmic, including also dissipative, material is preferred.

Preferably cellulose based material may be used, especially such material being provided with an extremely thin coating of plastic film as a protection against damp.

The charging of the particles may be effected in a previously known way upstream of the precipitator panels 11 or before the air is transported through the air flow duct or in some other way.

The embodiments according to the present invention may rather easily be provided with a device for removal (vacuum cleaning) of the collected dust, this of course further increasing the operational reliability of the device and its service intervals.

For certain applications, e.g. car coupe filters, it may be suitable, and due to the access to a forceful air blow from the motion of the car, to arrange for a reversed air flow through the precipitator panel and thus blow away the collected dust out in the free air, this being possible if an air flow is used by the reversed action that is several times more powerful than the designed operational condition.

Suitable gap distance "d" should for car coupe filters be less than 2 mm. The area enlargement factor X should be higher than 4. By demand for a low volume this affects the depth of the precipitator panels 11. Suitable panel depth is less than 3.5 cm and preferably less than 2 cm.

Due to the relatively high enlargement factor X that is designed for this invention the dust collection will take place on the top of the inlet area of respective precipitator and only micro dust will adhere to the plane surfaces of the electrode elements 01 or 02. By decreasing gap distance "d" the deposition of dust upon the inlet area of the precipitator increases proportionally. Thereby it is both simple and effective to remove dust collection by having the vacuum cleaner nozzle to sweep over the precipitator panels and the inlet areas respective.

The precipitator panels 11 are designed to be located in ventilating ducts as is shown in FIGS. 1 to 3 and 4, 5. The air flow may be effected by mechanical fans provided in the ventilating ducts or in some other way, e.g. through natural draught.

Nothing prevents that precipitator panels are arranged in accordance with the principles of FIGS. 1–5, although the precipitators being in a separate casing of preferably cellulose based material, said casing having such external dimensions that they are directly adapted for standardised dimensions of ventilating ducts. The advantage is a simple and hygienic handling including the possibility of incorporation of the entire device in connection with exchange, especially if there is a risk that contaminated dust is separated in the device.

Such a device may of course also include ionisation chambers having the walls of the duct as target electrode and an ionisation source according to previously known embodiments, the entire system being connected to a high voltage source in a suitable way.

What is claimed is:

1. Device for cleaning air from electrically charged particles (aerosols), said device including at least one precipitator panel, said panel including at least one precipitator unit having at least two electrode elements or at least two groups of electrode elements, said elements being located alternately relative to each other by an internal gap distance (d), said electrode elements being suitably connected to respective terminals of a high voltage source, said device being located in an air flow duct or in immediate connection with an air flow duct, characterized in that the main plane of the precipitator panel is inclined relative to the direction of the air flow through the device, and that the precipitator panel is arranged in such a way that essentially all air transport takes place though said precipitator panel said at least one precipitator panel comprising a circular or rounded precipitator unit consisting of at least two band-shaped electrode elements arranged to circle several times around an axis or a bobbin body at an internal gap distance (d) relative to each other, said electrode elements being connected to a respective terminal of a high voltage source, said precipitator unit being recessed in the cover of said precipitator panel.

2. Device according to claim 1, characterized in that the device includes at least two precipitator panels in a common main plane.

3. Device according to claim 1, characterized in that the device includes at least two precipitator panels in different main planes, said panels being joined at one edge.

4. Device according to claim 1, characterized in that the device includes at least two precipitator panels in different main planes, said panels being parallel to each other.

5. Device according to any of claim 1, characterized in that the precipitator panel is located in a space in immediate connection with the air flow duct, said space having a substantially larger cross section area than the air flow duct seen in the direction of the air flow through the device.

6. Device according to claim 1, characterized in the depth (b) of the precipitator panel is dimensioned in relation to the gap distance (d) between adjacent electrode elements and depth (b) being less than 10 cm. when distance "d" is 4 mm. and less than 8 cm. when distance "d" is 2.4 mm., with the maximum distance "b" comprising an intermediate value increasing in straight-line relationship between 8 and 10 when distance "d" is between 2.4 mm. and 4.0 mm.

7. A device according to claim 6, wherein said depth "b" is less than 5 cm. when said distance "d" is approximately 0 mm, and the maximum value of distance "d" comprises an intermediate value increasing in straight-line relationship between 5 cm. and 8 cm. when said distance "d" is between approximately 0 mm. and 2.4 mm.

8. Device according to claim 1, characterized in that an area enlargement factor (X) is dimensioned in relation to the gap distance (d) between adjacent electrode elements said area enlargement factor being at least 1.1 when "d" is about 0.3 mm. and at least 2.7 when "d" is 4 mm., with the minimum value for "X" comprising an intermediate value increasing in straight-line relationship between 1.1 and 2.7 when "d" is between 0.3 mm. and 4 mm.

9. A device according to claim 8, wherein said area enlargement factor "X" is at least 2.0 when said distance "d" approximates 0 mm., said "X" is at least 5.2 when "d" is 4 mm., and the minimum value for "X" comprising an intermediate value increasing in straight-line relationship between 2 and 5.2 when "d" is between 0 mm. and 4 mm.

10. Device according to claim 1, characterized in that cellulose based material is used for the electrode elements, said material being coated by a damp resistant film.

* * * * *